US005238167A

United States Patent [19]

Howard et al.

[11] Patent Number: 5,238,167

[45] Date of Patent: Aug. 24, 1993

[54] POSITIONING MECHANISM FOR POWERED FASTENER-DRIVING TOOL

[75] Inventors: Frank C. Howard, Mount Prospect; Mohamed K. Wagdy, Arlington Heights; Reinhold Meditz, Lake Zurich, all of Ill.

[73] Assignee: Illinois Tool Works Inc., Glenview, Ill.

[21] Appl. No.: 958,816

[22] Filed: Oct. 9, 1992

[51] Int. Cl.[5] ..... B25C 7/00

[52] U.S. Cl. ..... 227/110; 277/8; 277/32; 277/119

[58] Field of Search ..... 227/15, 16, 18, 31, 227/32, 110, 60, 8, 107, 140, 139, 119; 29/432

[56] References Cited

U.S. PATENT DOCUMENTS

| | | | |
|---|---|---|---|
| 2,506,038 | 5/1950 | Rakusin | 227/31 |
| 3,670,941 | 6/1972 | Grinnell et al. | 227/8 |
| 3,820,705 | 6/1974 | Beals | 227/110 X |
| 4,485,952 | 12/1984 | Weis | 227/32 X |
| 4,731,917 | 3/1988 | Krowl | 227/32 X |
| 4,928,867 | 5/1990 | Jensen | 227/7 |
| 5,025,968 | 6/1991 | Nasiatka | 227/31 X |
| 5,052,607 | 10/1991 | Dutton | 227/107 |

*Primary Examiner*—Frank T. Yost
*Assistant Examiner*—Rinaldi Rada
*Attorney, Agent, or Firm*—Schwartz & Weinrieb

[57] ABSTRACT

In pneumatically powered combustion-powered fastener-driving tool including a nosepiece, a mechanism is provided for positioning the tool relative to an opening in a workpiece to be fastened to another workpiece. A probe connected to an actuator used in such a tool, preferably via a spring strip, so as to be laterally movable extends into the opening to align the nosepiece so that a fastener can be precisely driven. The probe has a surface engageable by a driven fastener to move the probe laterally and from the opening as the tool recoils. Optionally, a guide spaced from the probe and mounted pivotally is adapted to bear against the workpiece with the opening. The probe and the guide have respective grooves defining a channel for guiding a driven fastener.

20 Claims, 4 Drawing Sheets

POSITIONING MECHANISM FOR POWERED FASTENER-DRIVING TOOL

TECHNICAL FIELD OF THE INVENTION

This invention pertains to a mechanism for positioning the nosepiece of a powered fastener-driving tool so that a fastener can be precisely driven through an opening in a workpiece to be fastened to another workpiece. The mechanism comprises a probe mounted to the nosepiece so as to be laterally movable and adapted to extend into the opening. When a surface of the probe is engaged by a driven fastener, the probe is moved laterally and from the opening as the tool recoils, or in other words, as the fastener is driven.

BACKGROUND OF THE INVENTION

Commonly, a pneumatically powered or combustion-powered fastener-driving tool is used for driving a fastener, such as a nail, through an opening in a workpiece, such as a metal channel, into another workpiece adjacent the workpiece with the opening. Typically, such a tool has a nosepiece, which is arranged to guide a driven fastener. Because such a tool tends to obscure the opening, it can be very difficult to align the nosepiece so that a fastener can be precisely driven through the opening.

Positioning or pointing mechanisms are known for aligning the nosepiece of a pneumatically powered fastener-driving tool relative to an opening in a workpiece but are rather complicated. Dutton U.S. Pat. No. 5,052,607 exemplifies such a mechanism.

There has been a need, to which this invention is addressed, for a simple mechanism useful on a pneumatically powered tool or on a combustion-powered tool for aligning the nosepiece of such a tool so that a fastener could be precisely driven through an opening in a workpiece.

SUMMARY OF THE INVENTION

This invention provides a mechanism for positioning the nosepiece of a powered fastener-driving tool so that a fastener can be precisely driven through an opening in a workpiece to be fastened to another workpiece. The mechanism comprises a probe connected to the nosepiece so as to be laterally movable and adapted to extend into the opening so as to align the nosepiece with respect to the opening so that a fastener can be so driven. The probe has a surface engageable by a driven fastener to move the probe laterally and from the opening as the tool recoils.

Preferably, the probe has a tapered end adapted to extend into the opening. The mechanism may further comprise means for biasing the probe laterally to a position wherein the aforenoted surface is engageable by a driven fastener.

Optionally, the positioning mechanism further comprises a guide mounted to the tool and spaced from the probe for guiding a driven fastener between the probe and the guide. The guide may have a bevelled end adapted to bear against the workpiece, containing the opening, when the probe extends into the open an a the probe has been moved laterally and from the opening.

The guide may be mounted pivotally to the tool so as to be pivotable between a position wherein the guide covers the opening partially when the probe extends into the opening and a position wherein the guide clears the opening. The guide may be arranged to be engaged by a driven fastener to pivot the guide to the position wherein it clears the opening.

Preferably, the probe has a groove and the guide has a groove facing the groove of the probe. The grooves define a channel for guiding a driven fastener.

Advantageously, the positioning mechanism may be used in a powered fastener-driving tool not only having a nosepiece, as discussed above, but also having a mechanism for disabling the tool unless an actuator movable between an extended position and a retracted position and biased to the extended position is moved to the retracted position. The probe of the positioning mechanism may be connected to the actuator so as to be conjointly movable with the actuator and so as to be laterally movable.

In a tool having such a disabling mechanism, the positioning mechanism may further comprise a spring strip having a proximal end and a distal end. Thus, the spring strip is mounted to the actuator, near the proximal end, and to the probe, near the distal end. Also, the spring strip is adapted to flex so as to permit the probe to be laterally moved by a driven fastener engaging the previously mentioned surface of the probe.

BRIEF DESCRIPTION OF THE DRAWINGS

These and other objects, features, and advantages of this invention will become evident from the following description of a preferred embodiment of this invention and an alternative embodiment thereof with reference to the accompanying drawings, in which like reference characters designate like or corresponding parts throughout the several views, and wherein.

DETAILED DESCRIPTION OF ILLUSTRATED EMBODIMENTS

Figure 1:
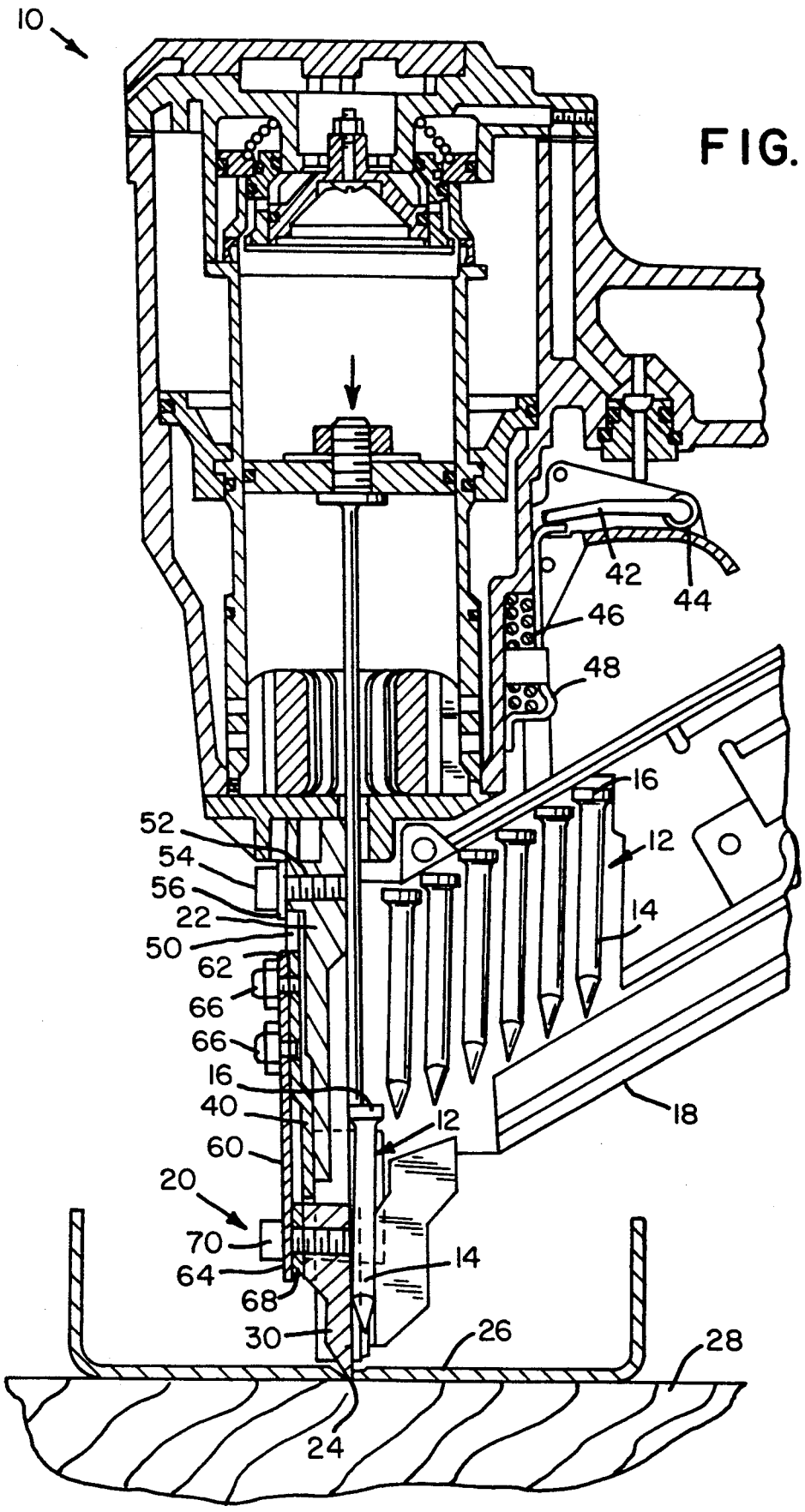
FIG. 1 is a fragmentary, cross-sectional view of a pneumatically powered fastener-driving tool incorporating a positioning mechanism according to a preferred embodiment this invention.

As shown in FIG. 1, a pneumatically powered fastener-driving tool 10 for driving fasteners exemplified by wire nails 12 having pointed shanks 14 and enlarged heads 16, as fed from a magazine 18 of the tool 10, comprises a mechanism 20 according to a preferred embodiment of this invention for positioning a nosepiece 22 of the tool 10 so that a nail 12 can be precisely driven by the tool 10, through a circular opening 24 of a workpiece 26, into another workpiece 28 adjacent the workpiece 26 with the opening 24. The mechanism 20 comprises a probe 30 connected to the nosepiece 22 so as to be laterally movable. The probe 30 has a tapered end 32 adapted to extend into the opening 24 so as to align the nosepiece 22 so that a nail 12 can be so driven. The probe 30 has a rounded surface 34 engageable by the head 16 of a driven nail 12 to move the probe 30 laterally and from the opening 24 as the tool 10 recoils. As shown, the workpiece 26 is a metal channel, and the workpiece 28 is a wooden beam.

Except as illustrated and described, the tool 10 is similar to pneumatically powered fastener-driving tools known heretofore, as exemplified in Golsch U.S. Pat. No. 4,932,480, the disclosure of which is incorporated herein by reference. Such pneumatically powered fastener-driving tools are available commercially from ITW Paslode (a unit of Illinois Tool Works Inc.) of Lincolnshire, Ill., under its PASLODE trademark. Thus, the tool 10 has an actuator 40 mounted operatively to the nosepiece 22 and linked operatively to a lever 42, which is mounted pivotally to a trigger 44. The actuator 40 is movable upwardly and downwardly over a limited range of actuator movement and is biased downwardly by a spring 46 via a member 48 linked to the actuator 40. The actuator 40, lever 42, trigger 44, spring 46, and member 48 and certain valves and other elements of the tool 10 are arranged, in a well known manner, as a mechanism for disabling the tool 10 unless actuator 40 is moved upwardly so as to lift the lever 42.

To define the limited range of actuator movement, the actuator 40 has an elongate slot 50, through which a boss 52 on the nosepiece 22 extends. A machine screw 54 is threaded into a threaded socket in the boss 52. A washer 56 is interposed between the head 58 of the machine screw 54 and the boss 52. The machine screw 54 and the washer 56 retain the actuator 40 on the tool 10.

In such a tool, as known heretofore, such an actuator is adapted to be pressed firmly against a workpiece to move the actuator upwardly so as to lift such a lever. In the tool 10, however, the probe 30 is connected to the actuator 40 so as to be conjointly movable with the actuator 40 and so as to be laterally movable and is adapted to be pressed firmly against the workpiece 26 to move the actuator 40 upwardly so as to lift the lever 42.

Directional terms including "upwardly" and "downwardly" are used herein with reference to the tool 10 in its usual orientation, in which it is shown, but are not intended to limit this invention to any given orientation of the tool 10.

Figure 2:
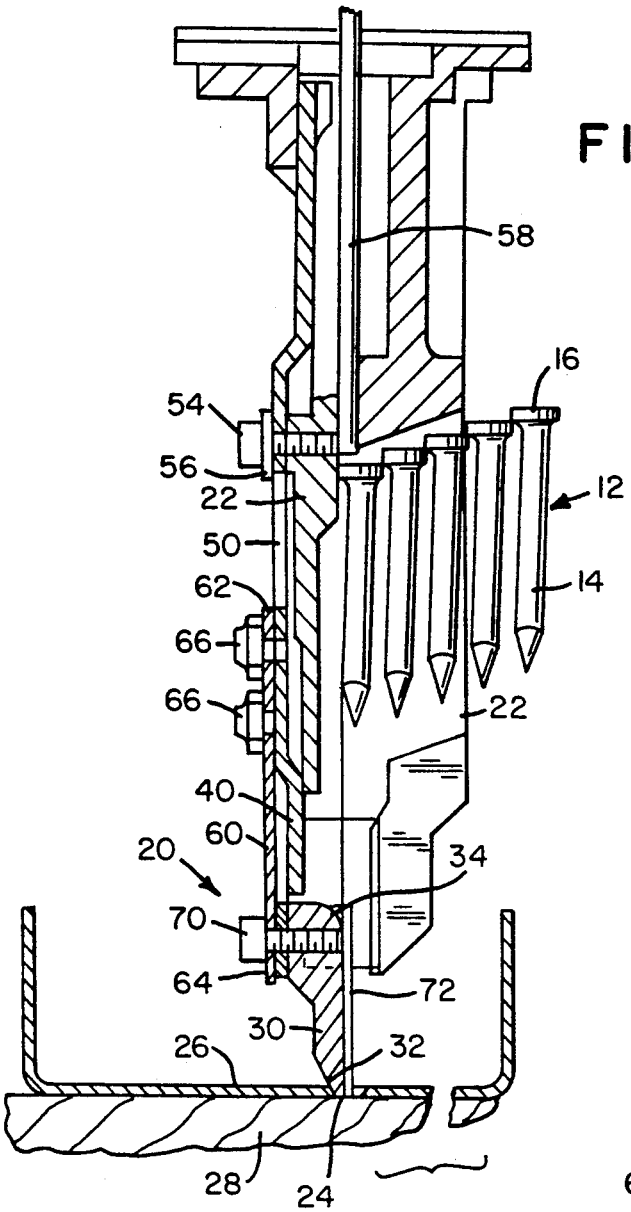
FIGS. 2, 3, and 4 are fragmentary, cross-sectional details of the positioning mechanism shown in FIG. 1, at various stages of tool operation.
Figure 3:
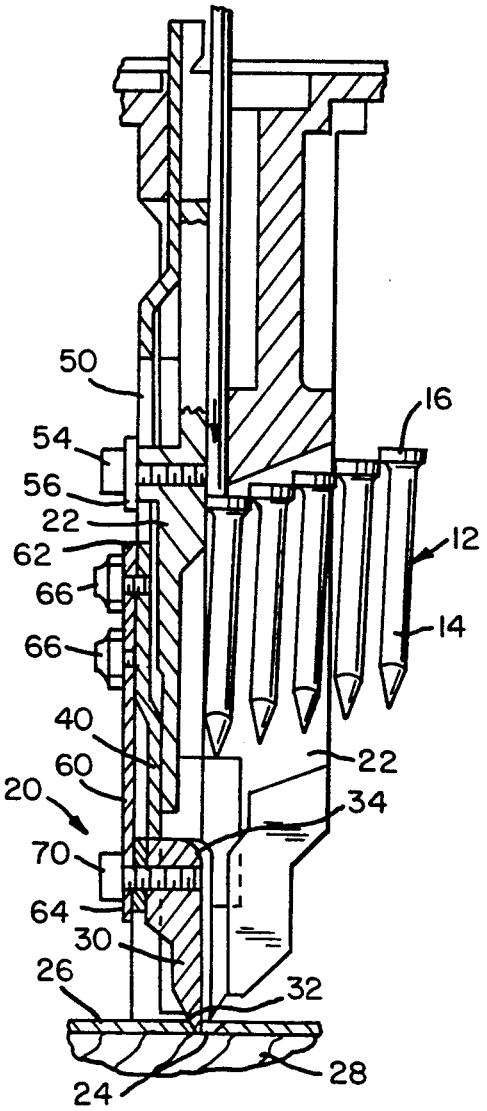
Figure 4:
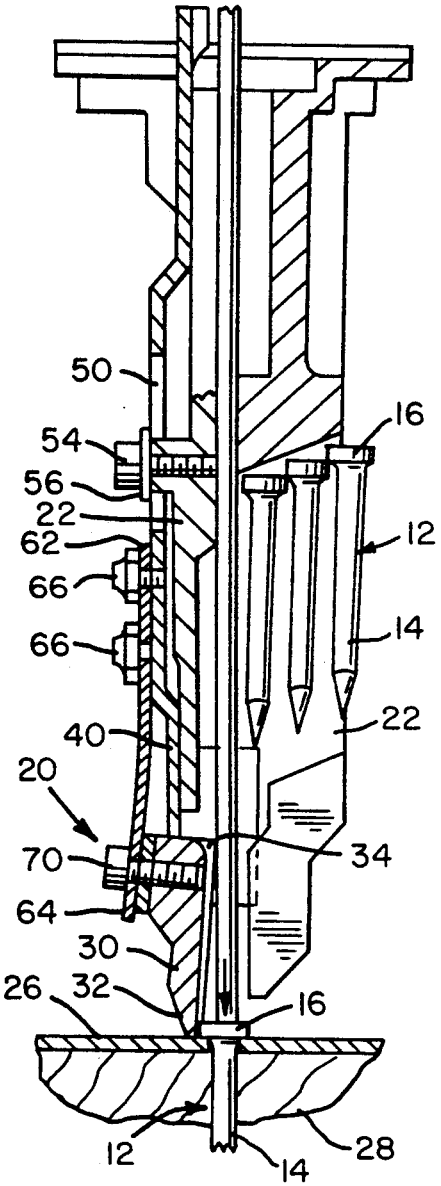
Figure 5:
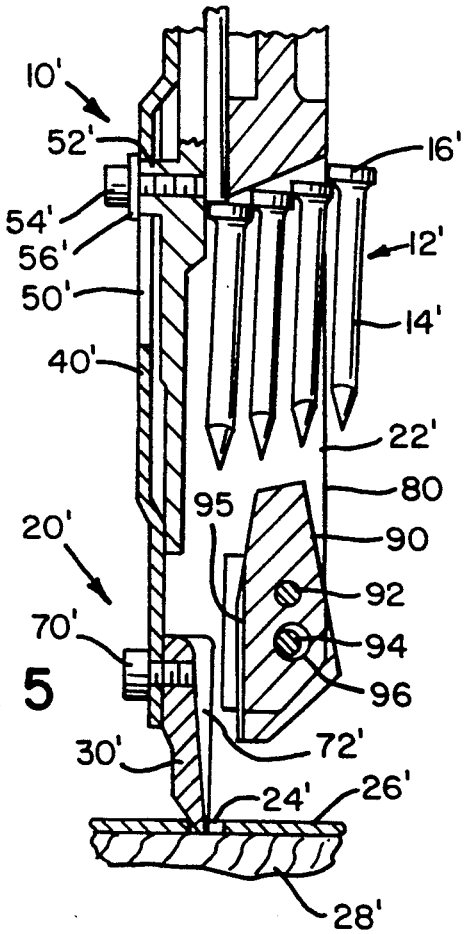
FIGS. 5, 6, and 7 are fragmentary, cross-sectional details of a positioning mechanism according to an alternative embodiment of this invention, at various stages of tool operation.
Figure 6:
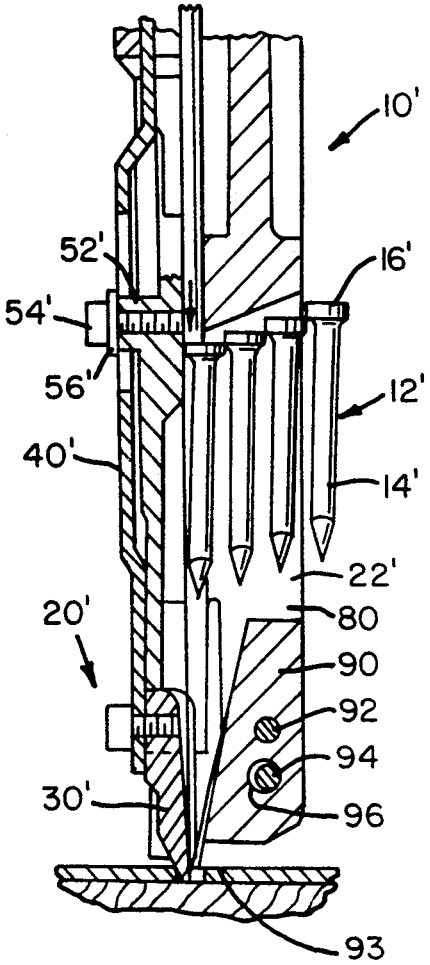
Figure 8:
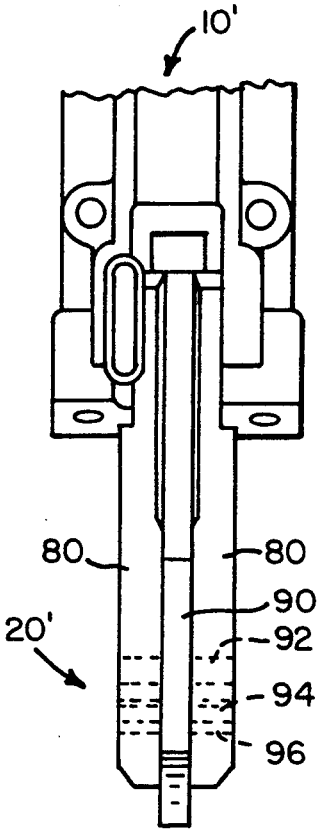
FIG. 8 is a fragmentary, elevational detail of the positioning mechanism shown in FIGS. 5, 6, and 7.
Figure 7:
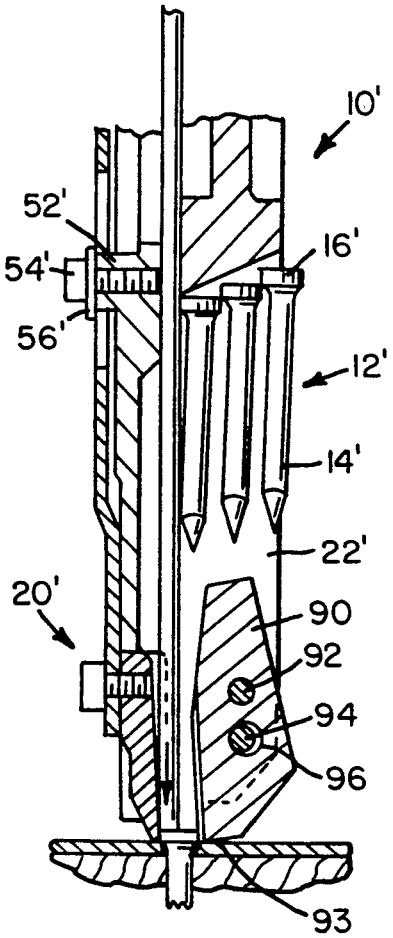

The positioning mechanism 20 comprises a strip 60 made of spring steel and having a proximal end 62 and a distal end 64. The spring strip 60 is mounted to the actuator 40, near the proximal end 62, via two machine screws 66. A washer 68 is interposed between the spring strip 60 and the probe 30. The probe 30 is mounted to the spring strip 60, near the distal end 64, via a machine screw 70. The spring strip 60 biases the probe 30 to a normal position (see FIGS. 1 and 2) wherein its rounded surface 34 is engageable by a nail 12 being driven but enables the probe to be moved laterally (see FIG. 4) to a displaced position. The actuator 40 is capable of some flexure when the spring strip 60 flexes. Such flexure of the actuator 40 is limited by the machine screw 54 and the washer 56.

As mentioned above, the opening 24 is circular. Preferably, the tapered end 32 of the probe 30 is shaped as one half of a frustum of a cone to guide the end 32 into the opening 24 and to fill approximately one half of the opening 24 when the end 32 is pressed firmly against the workpiece 26, at the margin of the opening 24. Moreover, the probe 30 defines a groove 72 facing laterally. When a nail 12 is driven by the ram 58, its shank 14 is driven along the groove 72 until its head 16 engages the rounded surface 34, whereupon the nail 12 moves the probe 30 laterally and from the opening 24 as the tool 10 recoils. The tapered end 32 can act as a camming surface, which can operate against the margin of the opening 24, as the tool 10 recoils.

In FIGS. 5 through 8, primed reference numbers are used to designate elements similar (except as illustrated and described herein) to elements designated by similar, unprimed reference numbers in FIGS. 1 through 4.

As shown in FIGS. 5 through 8, a pneumatically powered fastener-driving tool 10' for driving fasteners exemplified by wire nails 12' having pointed shanks 14' and enlarged heads 16', as fed from a magazine (not shown) of the tool 10', comprises a mechanism 20' according to an alternative embodiment of this invention for positioning a nosepiece 22' of the tool 10' so that a nail 12' can be precisely driven by the tool 10', through a circular opening 24' of a workpiece 26', into another workpiece 28' adjacent the workpiece 26' with the opening 24'. Except as illustrated and described herein, the tool 10' is similar to the tool 10', and the mechanism 20' is similar to the mechanism 20.

The nosepiece 22' differs somewhat from the nosepiece 22 in being bifurcated so as to define two spaced portions 80. The mechanism comprises a probe 30', which is similar to the probe 30. The tool 10' includes an actuator 40'. As compared to the actuator 40, the actuator 40' extends downwardly for a greater distance.

To define a limited range of the actuator movement, the actuator 40' has an elongate slot 50', through which a boss 52' of the nosepiece 22' extends. A machine screw 54' similar to the machine screw 54 and a washer 56' similar to the washer 56 retain the actuator 40' on the tool 10'. The probe 30' is mounted to the actuator 40', via a machine screw 70'. A boss 52' similar to the boss 52 extends through an elongate slot 50' in the actuator 40' to define a limited range of actuator movement. A machine screw 54' threaded into a threaded socket in the boss 52' and a washer 56' help to retain the actuator 40' on the tool 10'. There is no spring strip similar to the spring strip 60. However, the actuator 40' made of a steel is capable of some flexure which is limited by the machine screw 54' and the washer 56'. Such flexure is sufficient for the probe 30' to move laterally and from the opening 24' when the tool 10' recoils.

The positioning mechanism 20' further comprises a plate-like guide 90 mounted pivotably to the nosepiece 22', between opposite portions 80 via a pivot pin 92', so as to be pivotable between a covering position (see FIG. 6) wherein the guide 90 covers the opening partially when the probe extends into the opening and an uncovering position (see FIG. 7) wherein the guide 90 clears the opening. The guide 90 assumes a position (see FIG. 5) between the covering and uncovering positions when the tool 10' is held with the nosepiece 22' pointing downwardly. A cross pin 94 mounted to and between the spaced portions 80 of the nosepiece 22' extends loosely through an enlarged opening 96 in the guide 90 so as to limit pivotable movement of the guide 90 relative to the nosepiece 22'.

The guide 90 is spaced from the probe 30' and coacts with the probe 30, for guiding a nail 12' between the probe 30' and the guide 90. The guide 90 has a bevelled end 93, which is adapted to bear against the workpiece 26' with the opening 24' both when the probe 30' extends into the opening 24' and after the probe 30' has been moved laterally and from the opening 24'. The bevelled end 93 is shaped to coact with the workpiece 26' so as to pivot the guide to the covering position as the probe 30' enters the opening 24'. The guide 90 is arranged to be engaged by a driven nail 12' to pivot the guide 90 from the normal position to the uncovering position.

The probe 30' has a groove 72' facing laterally. The guide 90 has a groove 95 facing the groove 72' of the probe 30. In the covering position of the guide 90, the groove 95 is disposed to be engaged by the shank 14' of a driven nail 12'. The groove 72' of the probe 30' and the groove 95 of the guide 90 define a channel for guiding the driven nail 12' toward workpieces 26' and 28'.

Although the positioning mechanisms 20, 20', are shown as used in pneumatically powered fastener-driving tools 10, 10', a positioning mechanism according to this invention can be used alternatively in combustion-powered tools (not shown) of a type exemplified in Nikolich U.S. Pat. No. Re. 32,452, No. 4,403,722, No. 4,483,474, and No. 4,522,162, the disclosures of which are incorporated herein by reference. Such combustion-powered fastener-driving tools are available commercially from ITW Paslode, supra, under its IMPULSE trademark. Such combustion-powered tools comprise mechanisms for disabling such tools unless actuators analogous to the actuators 40, 40' and biased analogously are moved from extended positions to retracted positions so as to close combustion chambers of such tools.

Various modifications may be made in the preferred and alternative embodiments described above without departing from the scope and spirit of this invention. It is therefore to be understood that within the scope of the appended claims, the present invention may be practiced otherwise than as specifically described herein.

We claim:

1. In a powered fastener-driving tool including a nosepiece arranged to guide a fastener driven by said tool, a mechanism for positioning said tool relative to an opening defined within a workpiece to be fastened to another workpiece, comprising:

a probe connected to said nosepiece and adapted to extend into said opening of said workpiece so as to align said nosepiece with respect to said opening of said workpiece so that a fastener can be precisely driven through said opening of said workpiece; and means mounting said probe for engagement by a driven fastener so as to move said probe laterally and from said opening of said workpiece as said tool drives said fastener into said workpieces.

2. The mechanism of claim 1 further comprising means for biasing the probe laterally to a position wherein said probe is engageable by a driven fastener.

3. The mechanism of claim 1 wherein the probe has a tapered end adapted to extend into the opening of said workpiece.

4. The mechanism of claim 1 further comprising means including a guide mounted to the tool and spaced from the probe for guiding a driven fastener between the probe and the guide.

5. The mechanism of claim 4 wherein the guide has a bevelled end adapted to bear against the workpiece, having said opening, when the probe extends into the opening.

6. The mechanism of claim 5 wherein the bevelled end of the guide is adapted to bear against the workpiece, having said opening, after the probe has been moved laterally and from the opening.

7. The mechanism of claim 6 wherein the guide is mounted pivotally to the tool so as to be pivotable between a position wherein the guide covers the opening partially when the probe extends into the opening and a position wherein the guide clears the opening.

8. The mechanism of claim 7 wherein the guide is arranged to be engaged by a driven fastener to pivot the guide to the position wherein the guide clears the opening.

9. The mechanism of claim 7 wherein the probe has a groove and the guide has a groove facing the groove of the probe, the grooves defining a channel for guiding a driven fastener.

10. The mechanism as set forth in claim 7, wherein:

said nosepiece is bifurcated; and said guide is pivotably mounted upon said nosepiece and interposed between bifurcated portions of said bifurcated nosepiece.

11. The mechanism of claim 1, wherein:

said means mounting said probe comprises a flexible metal strip for permitting said lateral movement of said probe upon engagement of said probe by said driven fastener.

12. In a powered fastener-driving tool including a nosepiece arranged to guide a fastener driven by said tool, and means including an actuator movable between an extended position and a retracted position and biased toward said extended position for disabling said tool unless said actuator is moved toward said retracted position, a mechanism for positioning said tool relative to an opening defined within a workpiece to be fastened to another workpiece, comprising:

a probe connected to said actuator so as to be conjointly movable with said actuator and adapted to extend into said opening of said workpiece so as to align said nosepiece with respect to said opening of said workpiece so that a fastener can be precisely driven through said opening of said workpiece; and means mounting said probe for engagement by a driven fastener so as to move said probe laterally and from said opening of said workpiece as said tool drives said fastener into said workpieces.

13. The mechanism of claim 1 further comprising a spring strip having a proximal end and a distal end, the spring strip being mounted to the actuator near the proximal end and to the probe near the distal end, the spring strip being adapted to flex so as to permit the probe to be laterally moved by a driven fastener engaging said probe.

14. The mechanism as set forth in claim 12, further comprising:

means for biasing said probe laterally toward a position at which said probe is engaged by said fastener driven into said workpieces.

15. The mechanism as set forth in claim 14, wherein:

said means for biasing said probe comprises a flexible metal strip.

16. The mechanism as set forth in claim 15, wherein:

said metal strip is spring steel.

17. The mechanism as set forth in claim 12, wherein:

said probe has a tapered end adapted to extend into said opening of said workpiece.

18. The mechanism as set forth in claim 12, further comprising:

a guide mounted upon said tool and spaced from said probe so as to cooperate with said probe in guiding said driven fastener into said workpieces.

19. The mechanism as set forth in claim 18, wherein:

said probe has a first groove defined therein; and said guide has a second groove defined therein;

said first and second grooves of said probe and guide, respectively, defining a channel within which said driven fastener is disposed so as to be guided into said workpieces.

20. The mechanism as set forth in claim 18, wherein:

said nosepiece has a bifurcated construction; and said guide is pivotably mounted upon said nosepiece and interposed between bifurcated portions of said bifurcated nosepiece.

* * * * *